United States Patent [19]

Smith et al.

[11] Patent Number: 4,552,295

[45] Date of Patent: Nov. 12, 1985

[54] ANTI-WRINKLE DEVICE

[75] Inventors: Gary R. Smith, Overland Park, Kans.; Larry J. Rutter, Blue Springs, Mo.; James E. Amer, Kansas City, Kans.

[73] Assignee: Smith R.P.M. Corporation, Overland Park, Kans.

[21] Appl. No.: 663,795

[22] Filed: Oct. 23, 1984

[51] Int. Cl.[4] ..... D06C 3/06; B65H 25/26; B65H 17/22

[52] U.S. Cl. ..... 226/195; 226/190; 198/807

[58] Field of Search ..... 226/17, 18, 20, 189, 226/190, 194, 197, 195, 180; 198/806, 807, 808

[56] References Cited

U.S. PATENT DOCUMENTS

| | | | |
|---|---|---|---|
| 2,024,618 | 12/1935 | Whiting | 226/180 X |
| 2,817,940 | 12/1957 | Lorig . | |
| 2,822,169 | 2/1958 | Lorig . | |
| 3,017,061 | 1/1962 | Hobart et al. . | |
| 3,069,921 | 12/1962 | Davis . | |
| 3,299,801 | 1/1967 | Bishop | 226/190 X |
| 3,313,461 | 4/1967 | Andersen | 226/20 |
| 3,470,592 | 10/1969 | Robertson | 226/180 X |
| 3,838,481 | 10/1974 | Kuroda | 226/17 X |
| 4,003,411 | 1/1977 | Hasek . | |

*Primary Examiner*—Donald Watkins
*Assistant Examiner*—Lloyd D. Doigan
*Attorney, Agent, or Firm*—Litman, Day and McMahon

[57] ABSTRACT

A printing press, especially of the offset newspaper printing type, includes an anti-wrinkle roller to function in cooperation with a web of paper being printed by the press. The roller has a pair of sections which are each independently adjustable eccentrically with respect to a common central axis. The roller is mounted transverse to the web. The eccentrically adjustable sections of the roller are manipulative to compensate for uneven tension across the width of the web so as to provide uniform tension and thereby reduce wrinkles produced by uneven tension in the web. Manual adjustment knobs or remotely controlled motors may be alternatively utilized to selectively adjust the eccentricity of the roller sections relative to one another and to the central axis thereof.

12 Claims, 10 Drawing Figures

ANTI-WRINKLE DEVICE

BACKGROUND OF THE INVENTION

The present invention relates to a mechanism for reducing the number and degree of wrinkles within a web being printed on a printing press and, in particular, is directed to an anti-wrinkle roller construction for utilization with an offset continuous web newspaper press.

In continuous printing operations wherein a long sheet of paper is unrolled from a supply roll, especially newspaper printing, longitudinal wrinkles are a frequent problem. The wrinkles may be the result of one or more of the printing cylinders or guide rollers of the press being skewed so as to not rotate parallel to the axis of the paper supply or to other cylinders or rollers which over a period of time causes a difference in the tension on opposite sides of the paper web. Because of the difference in tension the paper tends to be urged transversely toward one side or the other of the web and longitudinally fold about some intermediate location. There are numerous other potential causes for a change in the tension of one side of the paper web from the other or of the sides relative to the center of the web, including poor paper stock in which the paper is inconsistent in thickness across the width of the web. As the paper supply rolls are usually quite large and the variance in thickness may be present along the entire length of the web, this small difference in paper thickness can accumulate over a substantial printing run with the result that the paper becomes taut or tensioned in certain locations across the width as it passes over the various rollers and cylinders of the press while being loose in other locations, thereby leading to the previously mentioned folds.

Sometimes the folds will not set or remain in the paper, but if the ink is applied while the fold is still there, then there will be a separation between the ink on opposite sides of the fold once the fold releases. On the other hand, if the fold sets after the ink has been placed on the web, then a portion of the printing will be precluded by the edges of the fold. Folds are often more likely to set or stay in the web in processes where the web is slightly dampened, for example, in offset printing where a dampening fluid is utilized.

Attempts have been previously made to provide a guide cylinder that would have an axis that could be skewed relative to other cylinders and rollers within a printing press to especially accommodate misalignment of the press rollers with the paper supply roll axis. Unfortunately, these cylinders are approximately the same width as the other cylinders within the press; it is only possible to make gross adjustment of the tension between the opposite sides of the web; and positioning such a cylinder to apply increased tension to one side of the web inherently prevents applying increased tension to the opposite side. What is desirable is a mechanism which will allow independent tensioning or relaxation of the web on either side thereof both relative to each side and to the center of the web. In this manner adjustment and tension can be made where, for example, the center of the paper is slightly thinner than either side.

It is noted that the theory associated with using a cylinder to adjust the tension on the web is basically as follows. If the web passes over the cylinder in such a manner that a transverse cross-section of the web in the longitudinal center of the part of the web engaging the cylinder is always parallel to the axis of the cylinder, then no relative relaxation or tension will be placed upon the web by that particular cylinder. On the other hand, if a first end of the cylinder is relatively radially outward in the direction of the web from the overall axis of rotation of the cylinder, while the cylinder opposite end is slightly radially inward toward the axis of rotation of the cylinder relative to the first end, then the edge of the web that engages the first end will have to travel further than the edge of the web that engages the second end. In such a configuration, as the web passes over the roller during a long printing run, relative tensioning begins to occur in the first end of the web and relative relaxing occurs in the second end of the web relative to the center of the web. This tensioning and relaxation on opposite sides of the web can be utilized to counterbalance opposite tensioning and relaxation produced in the web at the other locations or occurring naturally.

OBJECTS OF THE INVENTION

Therefore, the objects of the present invention are: to provide a continuous web printing press having an anti-wrinkle mechanism; to provide such a mechanism having at least two roller sections which are independently eccentrically adjustable and articulated relative to one another; to provide such a mechanism which has an outer cylindrical surface which is split in the center thereof and has adjustable bearings on opposite outer ends of the roller which allow such outer ends of the surface to be adjusted to rotate radially inward or outward relative to a central axis of rotation of the mechanism; to provide such a mechanism in which the eccentricity of either side thereof is adjustable either by manual manipulation, by operator remote control or by automated remote control utilizing sensors; and to provide such a mechanism which is economical to manufacture, suitable for long use and particularly well adapted for intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

SUMMARY OF THE INVENTION

An anti-wrinkle device is provided for use in cooperation with a continuous web printing press. The device includes structure supporting cooperating cylindrical surfaces which are independently eccentrically adjustable relative to a common central axis thereof. The cylinder surfaces are preferably placed axially adjacent to one another and are mounted relative to the press so as to transversly engage a surface of a continuous printing paper web passing through the press.

Preferably, the device includes two cylindrical sections each of which is rotatably mounted on a central shaft and each of which is independently mounted on an eccentrically adjustable mechanism, preferably associated with bearings allowing rotation of the section about the shaft, near outer edges thereof. Each of the outer edges of the sections can be independently adjusted relative to the central shaft and to each other so as to move the outer edges of each cylinder radially toward or away from the central shaft and common axis thereof preferably at the location whereat the section intermedially engages the paper web, that is, where the longitudinal center of that portion of the web engages the section. Preferably the sections may be aligned in this manner to be coaxial with one another and with the axis of the overall device, to be coaxial with one another but aligned at an angle relative to the axis of the overall device, and to be aligned in a vee or chevron formation relative to one another wherein the apex or point of the vee may point inward toward the central axis of the device or outward toward the paper web. It is noted that the relative angle between the tangency line of the section surface and the paper web relative to the central axis of the device is generally determinative as to how the device will affect the overall tension at various locations across the web. If such tangency lines along the surface are colinear and each is parallel to the axis of rotation of the overall device, then the tension on opposite sides of a web will not be greatly modified by passing over the device (although it is noted that if paper thickness is slightly different across the width of the web, then tension may inherently change in the web). On the other hand, if either of the tangency lines on the surface are angled relative to one another or if they are colinear relative to each other but angled relative to the axis of rotation of the device, then tension will be modified across the width of the web, assuming other parameters are held constant, in a manner which will be discussed below.

Eccentric adjustment means are provided for allowing selected modification of the eccentricity of outer ends of the device, and therefore, of the positions of the cylindrical surfaces relative to one another. In addition, preferably the adjustment means allows adjustment of the eccentricity of each end of the roller relative to a central axis of rotation of the device and comprises a set of bearing mechanisms with eccentric races. Also, the bearing mechanisms have a neutral position which allows the end of the roller associated therewith to be aligned in a manner that the cylindrical surface associated of that end of the device is coaxial with the overall axis of rotation of the device. In addition, the bearing mechanisms are adjustable to allow the end of an associated cylindrical surface to be radially adjusted toward or away from the overall axis of rotation of the device.

Preferably a control mechanism is provided for allowing easy manipulation of the adjustment means. The control mechanism may be designed alternatively to allow direct manual manipulation, remote manipulation by an operator or remote adjustment by an automatic wrinkle sensing device. For example, the adjustment means may include a gear mounted thereon which is rotatable relative to the axis of rotation of the device and which is suitably rotated by a hand crank or electric drive motor connected to the gear by a rotatable adjustment gear such as a worm gear or the like. For manual adjustment a crank or knob is provided for turning the adjustment gear. For remote control an electric, pneumatic or other type of suitable motor may be utilized which is controlled by conventional remote motor control systems and the like. A suitable sensing means may be utilized to indicate the position of the adjustment means, such as a potentiometer which senses the amount of rotation of the drive gear either directly or indirectly and provides a signal to a remote control location of the degree of such rotation. A wrinkle sensing device may be automatically linked to an adjustment motor to allow automatic control of the adjustment means. The automatic sensing device may comprise photoelectric or laser sensors which would detect wrinkles, a series of air vents arranged transversely to the flow of the web so as to cause a standard back pressure on the air vents except when a wrinkle is positioned opposite one of the air vents at which point excessive pressure is bled off in a manner which can be sensed, or the like.

Figure 2:
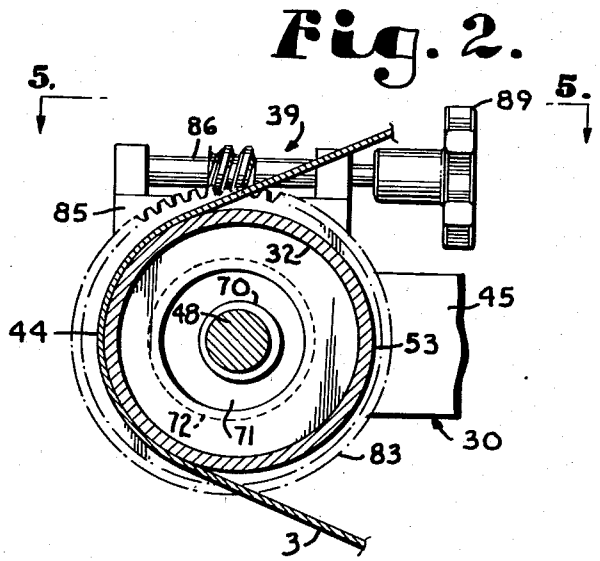
FIG. 2 is a cross sectional end view of the anti-wrinkle cylinder showing a section of the cylinder in a first concentric position.

It is noted that the angle of eccentricity of the sections of the roller shown in the figures has been exaggerated over the angle which would normally be used in order to better visually illustrate the invention. Normally, only a small change in the angle of the axis of each of the sections relative to one another or to the axis of rotation of the overall roller is sufficient to produce the tensioning or relaxation in the web which is desired.

DETAILED DESCRIPTION OF THE INVENTION

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Shown in FIGS. 1 through 7 is a continuous web newspaper press 1 incorporating an anti-wrinkle device generally designated by the reference numeral 2 The anti-wrinkle device 2 cooperates with a continuous paper web 3 being printed upon by the press 1 in such a manner as to control longitudinal wrinkles within the web 3.

Figure 1:
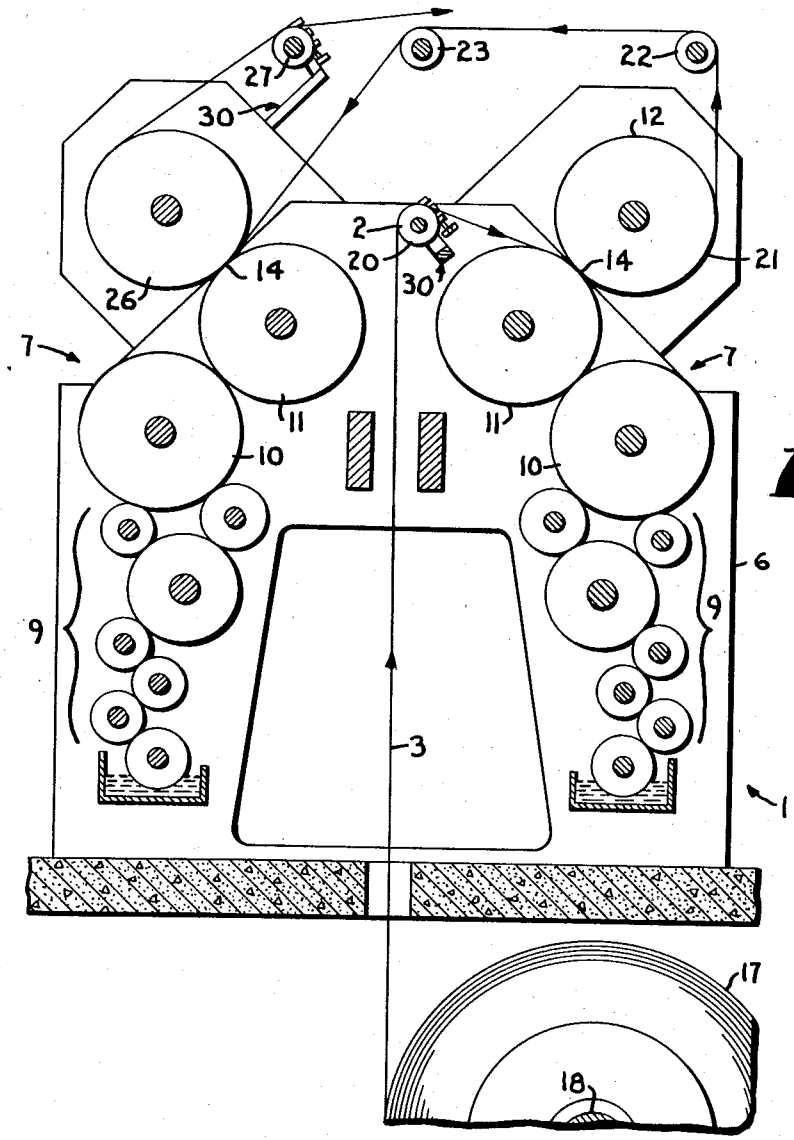
FIG. 1 is a diagrammatic cross sectional view of a newspaper printing press having two anti-wrinkle rollers according to the present invention associated therewith.

The illustrated press 1, as best seen in the schematic view in FIG. 1, is a conventional continuous web newspaper press having a frame or tower structure supporting a plurality of rotatable cylinders and drums each of which is rotatable on generally parallel axes and which combine together to form a printing unit 7. The tower structure 6 includes two printing units 7 and the web 3 is reeved to pass first through one and then the other printing unit 7 so as to be printed on each side of the web 3. Each printing unit 7 includes an inking train 9, an offset plate cylinder 10, an impression cylinder 11 and a blanket cylinder 12. The web 3 is reeved to pass between a bight 14 whereat each impression cylinder 11 abuts against an associated and cooperating blanket cylinder 12. The particular press 1, shown in FIG. 1, is especially suitable for rotary offset printing of newspaper stock. However, it is foreseen that the anti-wrinkle devices 2 of the present invention may be used in cooperation with presses which print other than newspapers and with presses that utilize other than offset printing modes, as long as a continuous web is being utilized therein.

In the embodiment shown in FIG. 1, the web 3 is unwound from a paper feed roll 17 spaced from the press 1. The feed roll 17 rotates about a central shaft 18. The web 3 is guided into and then through the press 1 by first passing over a first anti-wrinkle device 20, thereafter through the bight 14 associated with a first printing unit 21, thereafter the web 3 is reeved over freely rotating guide cylinders or rollers 22 and 23, after which the web 3 is reeved through a bite 14 associated with a second printing unit 26, and finally, thereafter, the web 3 is reeved to pass over a second anti-wrinkle device 27. It is foreseen that the web 3 may easily be reversibly reeved and/or the positioning of the guide rollers 22 and 23 along with the first anti-wrinkle device 20 and the second anti-wrinkle device 27 may be easily varied to modify the course of the web 3 through the press 1. The guide rollers and anti-wrinkle devices may be decreased or increased in number as required by a particular press or printing mode.

Referring to FIGS. 2 through 7 each of the anti-wrinkle devices 2 includes a support frame 30, a first cylindrical surface bearing member or anti-wrinkle roller 31, a second cylindrical surface bearing member or anti-wrinkle roller 32, a first eccentric adjustment mechanism 36 cooperating with the first cylindrical surface bearing member 31, a second eccentric adjustment mechanism 37 cooperating with the second cylindrical surface bearing member 32, a first adjustment mechanism positioning device 38 cooperating said first eccentric adjustment mechanism 36 and a second adjustment mechanism positioning device 39 cooperating with the second eccentric adjustment mechanism 37.

Each of the illustrated support frames 30 includes suitable side struts 45 mounted on the press tower structure 6 and a providing fixed mounting of the respective anti-wrinkle device 2 relative to the press tower structure 6. In the embodiment illustrated in FIG. 1, anti-wrinkle devices 20 and 27 are suitably positioned by the mounting angle and length of the support structure struts 45 to favorably engage the web 3. Preferably the center line of the longitudinal engagement of the web as with the rollers 31 and 32, indicated by the reference numeral 44 is positioned to enjoy maximum variation of the devices 2 as will be noted hereinafter. In the device 2 shown in FIG. 4, a fixed or non-rotating dead shaft 46 is mounted between the support structure struts 45. The shaft 46 includes a cylindrical central core 47 coaxially aligned with cylindrical outer segments 48 having a somewhat smaller diameter than the central core 47. The shaft 46 has a central axis 50 associated therewith.

The cylindrical surface bearing members 31 and 32 have outer cylindrical surfaces 52 and 53 respectively associated therewith. The surfaces 52 and 53 are generally equal in diameter and preferably equal in length, although it is foreseen that unequal diameters or variances in diameter may be utilized for certain installations. The cylindrical surface bearing members 31 and 32 are mounted so as to allow free rotation thereof about the shaft axis 50, although such rotation may be varied, as described below, to be eccentric or concentric rotation.

Adjacent inner edges 56 of each of the cylindrical surfaces are preferably closely spaced and rotate generally coaxial with one another. The inner ends of the members 31 and 32 are rotatably supported upon the shaft central core 47 by bearing units 58 and articulated relative to one another. The particular bearing units 58 illustrated in the presently described embodiment are of a roller bearing type in which roller bearings 60 ride on an inner race 61 non-rotatably mounted on the shaft central core 47 and an outer race 62 attached to and supporting a respective cylindrical surface bearing member 31 or 32 near respective edges 56 thereof. Preferably the roller bearings 60 utilized herein are of a self-adjusting type which allow rotation thereof not only in a plane perpendicular to the central shaft 46 upon which they are mounted but also allows some rotation about a plane which passes through the shaft axis 50. Examples of such bearings are Airframe Bearings type NBK or Torrington type 222. This self-adjustability in cooperation with the eccentric adjustment mechanisms 36 and 37 described below, allows both symmetrical and non-symmetrical alignment as well as coaxial and noncoaxial alignment of the cylindrical surfaces 52 and 53 relative to one another and to the overall axis of rotation 50. It is foreseen that bearing units other than those illustrated may be utilized for the described usage thereof; however, bearings providing a substantial support to the surfaces 52 and 53, while allowing the described rotation, are preferable as the web 3 moves at a high velocity and may exert substantial pressure against the surfaces 52 and 53.

Each of the cylindrical surfaces 52 and 53 further includes an outer edge 66 supported by the first eccentric adjustable mechanism 36 and the second eccentric adjustable mechanism 37 respectively. The illustrated eccentric adjustment mechanisms 36 and 37 comprise an eccentric inner bearing race 70, roller bearings 71 and an outer bearing race 72. The bearings 71 allow free rotation of the outer bearing race 72 with respect to the inner bearing race 70. The inner races 70 are each sleeved on a respective shaft outer segment 48 so as to be freely rotatable thereabout. The most radially outward surface or high lobe 73 of each inner race which engages respective bearings 71 is noncoaxially aligned relative to the shaft axis 50 which results in an eccentric bulge upon which the bearings 71 ride to one side of the shaft 46 and which is selectively positionable by rotation of the race 70 relative to the axis 50. Each of the outer bearing races 72 is attached to and supports an associated cylindrical surface bearing member or anti-wrinkle roller 31 or 32. As one of the inner races 70 is rotated upon the shaft 46, an associated outer race 72 and cylindrical surface outer edge 66 rotates so as to be selectively eccentrically positioned about the shaft axis 50 also. Thus, the surfaces 52 and 53 are free to rotate about the axis 50, but have a selectively positionable eccentricity associated therewith.

Figure 3:
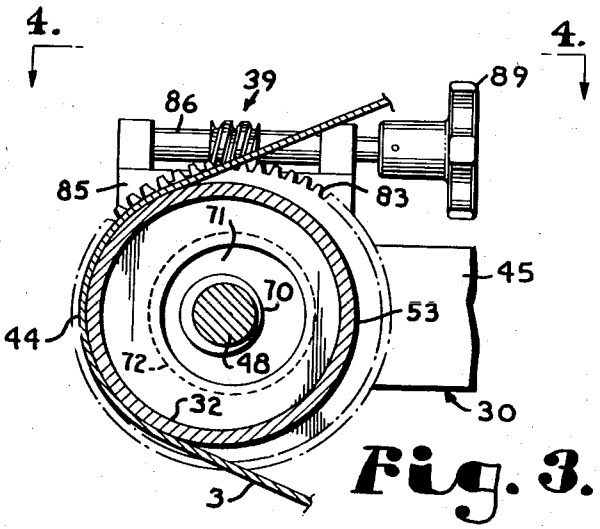
FIG. 3 is a view similar to FIG. 2 wherein the section is shown in a second eccentric position thereof.

The web 3 preferably engages the cylindrical surfaces 52 and 53 such that the tension across the web 3 can be maximized or minimized, while also allowing the respective inner races 70 of each of the cylindrical surfaces 52 and 53 to be selectively aligned as to cooperate with the bearing units 58 to make the cylindrical surfaces 52 and 53 coaxial with one another when desired. Referring to FIGS. 2 and 3, maximum tension or relaxation can be applied across the web 3 by movement of the ends of the rollers 32 and 33 respectively to the left or right, while movement of the ends in the vertical direction only minimally affects the tension across the web 3 because the center line 44 of engagement of the web with the rollers is substantially in a horizontal plane with the axis 50. Each of the inner races 70 has attached thereto, axially outward from associated bearings 71, a generally radially symmetrical drive wheel 80 which is rotatable about the shaft 46. Although not illustrated, the inner races 61 of the bearing units 58 are eccentric with the bulge oriented upward as would be viewed in FIGS. 2 and 3. By this means, when the bulges of the inner races 70 of the end bearing units are oriented upwardly, that is, in the same direction as the bulges of the races 61, the anti-wrinkle device 2 is at a neutral adjustment; and no tension is added to or subtracted from the web 3. In this state, the rollers 32 and 33 are coaxial and the axes thereof are parallel to the axis 50.

Respective drive wheels 80 are coaxially connected to the first and second adjustment mechanism positioning devices 38 and 39 each comprising a drive gear 83 coaxial with and rotating upon an associated shaft outer segment 48. Each gear 83 is secured by bolts or the like to an associated inner race drive wheel 80. Each of the adjustment mechanism positoning devices 38 and 39 further include a worm gear support block 85 non-rotatably mounted with respect to the shaft 46. The worm gear support block 85 has rotatably mounted thereon a worm shaft 86 supporting a worm gear 87 which meshes with gear 83. A turning mechanism such as handle or knob 89 coaxially attached to a respective shaft 86 allows rotation of the worm gear 87 and consequent rotation of the gear 83, so as to allow variable and selective adjustment of the position of the eccentric bulge of a respective inner race 70 and consequently of the eccentricity of an outer edge 66 of a respective cylindrical surface 52 or 53. In certain installations frictional engagement of the worm gear 87 with the gear 83 provides a locking mechanism to hold a respective cylindrical surface 52 or 53 in a desired eccentric position relative to the axis 50, although it is foreseen that a removable locking pin or the like may be also utilized for this purpose where friction is insufficient.

Figure 5:
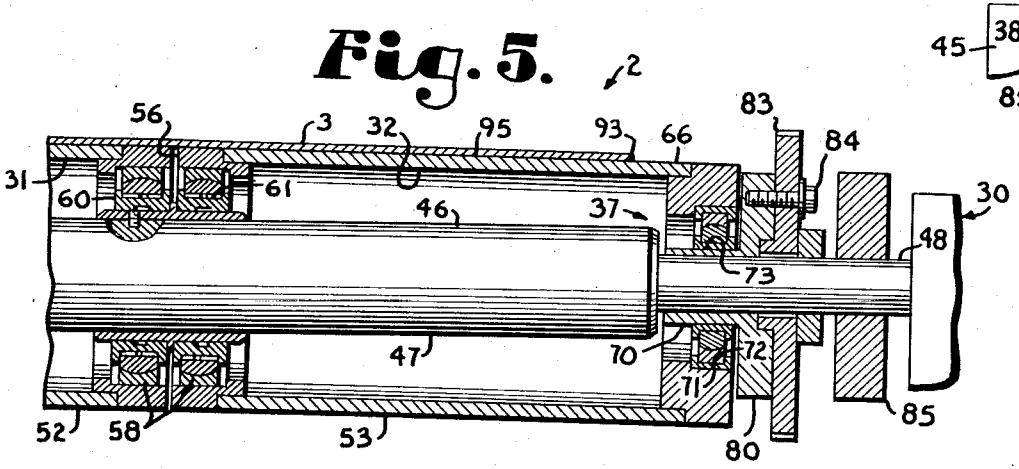
FIG. 5 is a fragmentary view of the roller similar to FIG. 4 and taken along line 5—5 of FIG. 3 wherein the right hand section has an outer edge which is radially inward relative to the inner edge of the section on the side of the section engaging a paper web.

In use, the press 1 is fitted with anti-wrinkle devices 2 to reduce longitudinal wrinkling in the web 3 by adjusting tension in sides or edges 92 and 93 of the web 3 relative to a center or medial location 94 therealong. Such devices 2 may be positioned before the web 3 is printed, such as the device 20, at various intermediate printing steps (not shown), or after printing is complete such as device 27. When tensioning is to be adjusted upon the opposite sides of 92 and 93 of the web 3 in order to retard or prevent wrinkling, the knobs 89 are selectively rotated by an operator to overcome what the operator perceives or measures as unbalanced tension or to compensate for slack in the web opposite sides 92 and 93 both relative to each other and to the center 94. For example, FIG. 5 illustrates a first mode of operation in which the cylindrical surfaces 52 and 53 are coaxially aligned relative to one another and the cross-section of the surfaces 52 and 53 whereat the device 2 engages the longitudinal center of the web 3, seen in FIG. 5, parallelly aligns with the axis 50. In this first mode of operation additional tension is placed on neither web side 92 or 93 relative to one another or to the web center 94, since the web 3 passes over these cylindrical surfaces 52 and 53 generally coaxial with respect to the axis 50 of rotation of the overall device 2.

Figure 4:
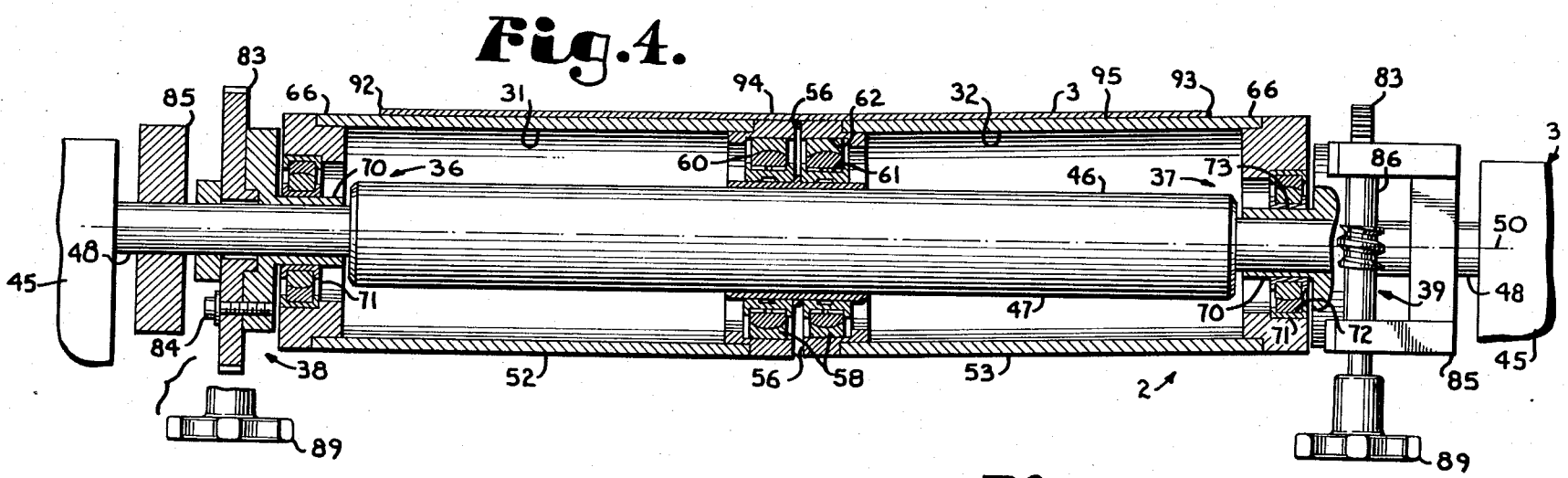
FIG. 4 is a longitudinal sectional view taken on line 4—4 of FIG. 2 and illustrates the anti-wrinkle roller having a pair of outer cylindrical sections, wherein a right hand section has an outer edge which is radially outward from a central axis of rotation of the roller relative to a header edge of the section and of the left section.

In FIG. 4 a second mode of operation is shown wherein the cylindrical surface 53 has been adjusted through cooperative repositioning of the parts of the device 2 due to rotation of the knob 89 with respect to its position in FIG. 5 so as to exert more tension on the web edge 93 than on the web central portion 94. That is, in FIG. 4 the longitudinal center of engagement of the cylindrical surfaces 52 and 53 within the web 3 is denoted by the reference numeral 95. The center of engagement 95 along the outer edge of surface 53 is spaced radially farther from the axis of rotation 50 than at the web center 94 or along the center of engagement associated with surface 52 which is generally parallel to the axis 50.

Figure 6:
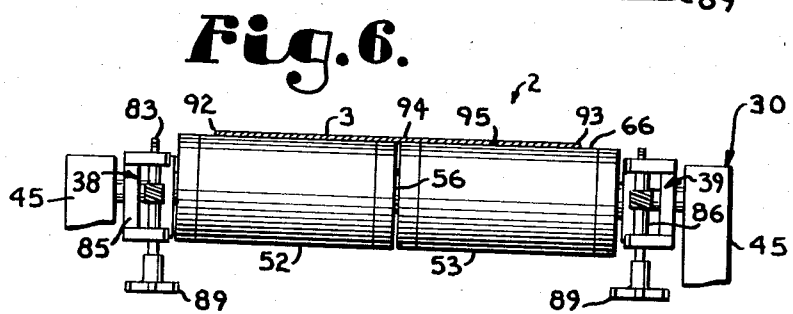
FIG. 6 is a fragmentary view of the roller at a reduced scale showing a modified position of the left and right sections wherein the sections are axially aligned with one another but not axially aligned to the axis of rotation of the roller.

Illustrated in FIG. 6 is a third mode of operation in which the cylindrical surface 53 is adjusted such that center of engagement 95 at the web edge 93 is radially closer to the axis 50 than at the web center 94 and the web outer edge 92 is spaced further away from the axis 50 than the web center 94. The third mode of operation is particularly suitable for compensating for misalignments of the axis of rotation of either the paper feed roll 17 or the various impression cylinders 11 or blanket cylinders 12 with one another. In the third mode of operation the surfaces 52 and 53 are generally coaxially aligned with each other but rotate on axes which are skewed or non-parallel to the overall axis of rotation 50.

Figure 7:
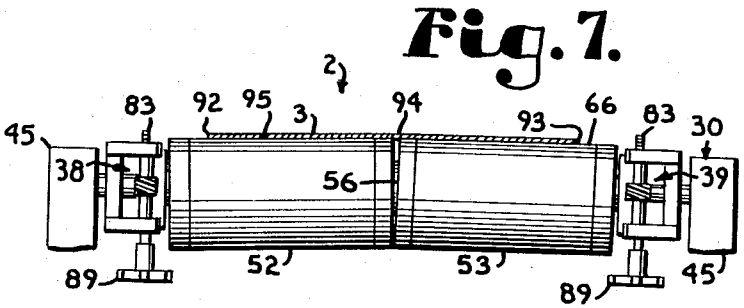
FIG. 7 is a view similar to FIG. 6 of the roller wherein the left and right sections of the roller are non-axially aligned with one another and with the axis of rotation of the roller.

In FIG. 7 is seen a fourth mode of operation wherein both outer edges 92 and 93 of the web 3 along the center of engagement 95 are spaced relatively radially closer to the axis 50 than is the web center 94. In this fourth mode of operation relatively increased tension is placed upon the web center 94 relative to the outer edges 92 and 93. This fourth mode of operation is especially suitable for where the paper web outer edges 92 and 93 are slightly thicker than the medial portion 94. It is foreseen that various combinations of the first through fourth modes of operation shown in FIGS. 4, 5, 6 and 7 may be utilized to correct for combination problems resulting in variations in tensioning of the web 3 across the transverse cross section thereof.

Figure 9:
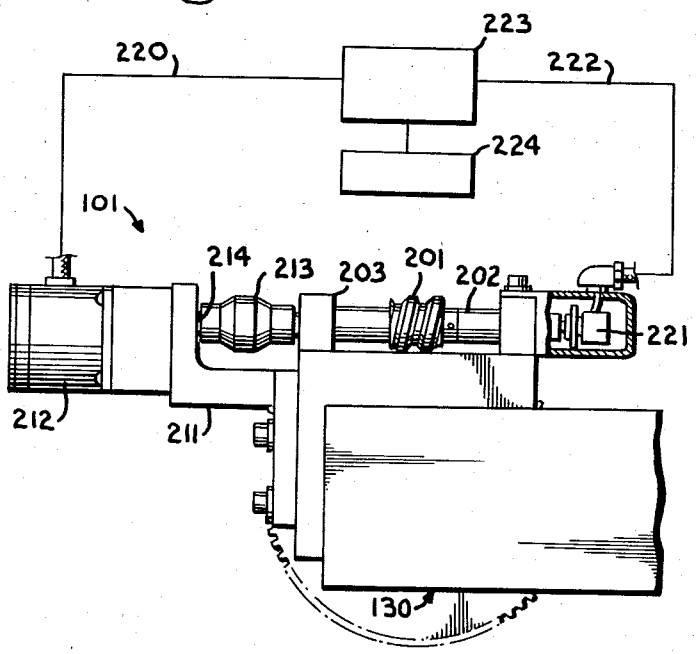
FIG. 9 is a fragmentary end view of the modified anti-wrinkle device including a schematic view of a control mechanism for the device.
Figure 8:
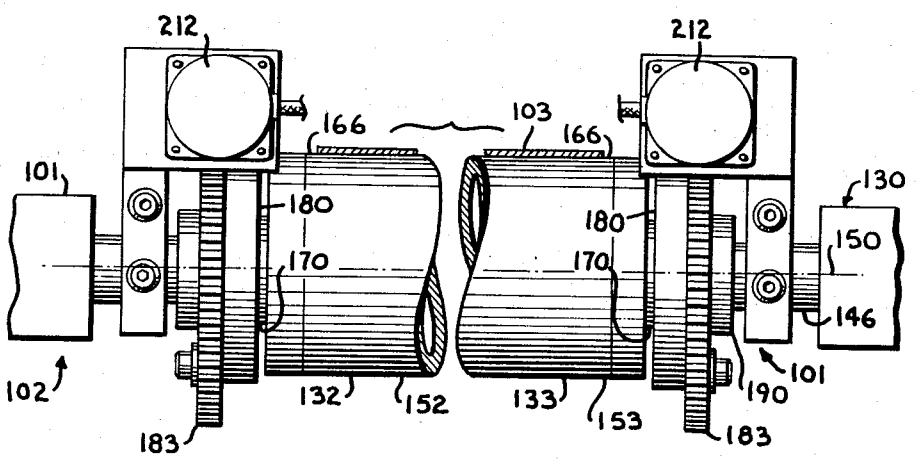
FIG. 8 is a fragmentary side elevational view of a modified anti-wrinkle device according to the present invention, including a motor drive unit.
Figure 10:
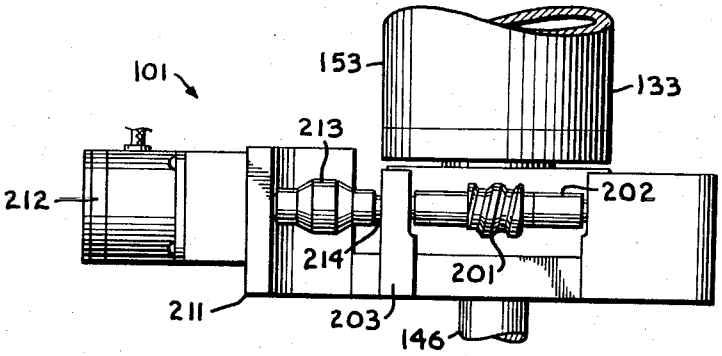
FIG. 10 is a fragmentary top plan view of the modified anti-wrinkle device.

FIGS. 8, 9 and 10 illustrate a second embodiment of the present invention generally comprising an anti-wrinkle device 102 suitable for use with a continuous web printing press 101. The press 101 is substantially similar to the press 1 described in the previous embodiment and, therefore, is not shown and described in detail for the present embodiment. Each anti-wrinkle device 102 includes cylindrical surface supporting members or anti-wrinkle rollers 132 and 133 supporting cylindrical surfaces 152 and 153 respectively which are in general quite similar to the surfaces 52 and 53 described for the previous embodiment. As inner and outer bearing units for the cylindrical surface supporting members 132 and 133 are essentially similar to the bearing units for the supporting members 31 and 32 described for the previous embodiment, these features will not be again described in complete detail herein. Reference is made to the previous embodiment for complete description of these parts.

Outer bearing units for surface supporting members 132 and 133 include bearing races 170 which, again, are generally similar to the bearing races 70 of the previous embodiment and have rotatable drive wheels 180 connected thereto. Each of the drive wheels 180 is attached to a gear 183, again similar to gear 83 of the previous embodiment. Each of the gears 183 is rotatable about a central shaft 146 having an axis 150 so as to eccentrically adjust outer edges 166 of the associated cylindrical surfaces 152 or 153 relative to the axis 150 through manipulation of the relative position of a respective bearing race 170 in a manner generally discussed for the previous embodiment.

A collar 190 is secured to the shaft 146 to effectively maintain a respective race 170 and support member 132 or 133 in a generally fixed axial location relative to the shaft 146. A shaft 146 is supported in fixed relationship to the press 101 by a support frame 130 and is non-rotatable relative to the frame 130.

A worm gear 201 is mounted to mesh with the gear 183 and is supported by a worm shaft 202 rotatably mounted in a worm gear support block 203. The block 203 is non-rotatable relative to the shaft 146. A motor 212 is also mounted on the block 203 by motor support 211 and operably is positioned such that a flexible connector or coupling 213 axially connects the motor shaft 214 with the worm gear shaft 202. The motor 212 of this embodiment is electrically driven although it is foreseen that other types of motors such as pneumatic or hydraulic may be utilized for this purpose. The motor 212 is preferably highly controllable relative to a desired degree of rotation of the worm gear shaft 202 so as to precisely control rotation of such gear 202 and consequently the position of the eccentric bulge of the outer ends of the surfaces 152 or 153 respectively. Angular positioning of the relative eccentric bulge in turn determines the relaxation or tension placed on a location across the web 103 engaging the respective surface 152 or 153 in a plane radially extending outward relative to the shaft 146.

As best seen in FIG. 9, the motor 212 has associated therewith a motor control cable 220. Associated with the worm gear shaft 202 opposite the motor 212 is an angular position sensing potentiometer 221. Cable 222 carries a position indicating signal from the potentiometer to a controller 223 connected to the motor 212 through the cable 220. The controller allows an operator remote from the device 102 to both discern the angular position of the shaft 202 relative to a fixed position and to consequently determine the relative eccentric position of associated outer ends 166. The controller 223 also allows the operator to selectively power the motor 212 through the supply 220 to rotate the gear 202 either forward or backward to adjust eccentricity.

Alternatively a wrinkle sensor 224 is provided for the controller 223 which automatically senses wrinkles at a location along the web 103 and is positioned to automatically cooperate with the controller 223 to optimize eccentricity on the surfaces 152 and 153. The sensor 224 may be a scanning laser means positioned to detect thickness changes in the web 103 due to wrinkles, multiple air jets that are positioned transversely across the web and which have different sensible back pressures associated therewith depending on whether the web 103 is wrinkled at a location or not, and the like. Alternatively, other types of wrinkle sensors could be employed.

It is to be understood that while certain forms of the present invention have been illustrated and described herein, it is not to be limited to the specific forms or arrangement of parts described and shown.

We claim:

1. An anti-wrinkle device for controlling wrinkles in a moving elongate paper web engaging said device; said device comprising:

(a) a support structure;

(b) said support structure including a central shaft;

(c) first and second supporting members;

(d) first and second surfaces adapted to engage a side of the web and being supported by said first and second supporting members respectively, each of said first and second surfaces having a respective first end and a second end;

(e) said first and second supporting members are each rotatable about said shaft such that said first and second surfaces rotate about an axis associated with said shaft;

(f) said surfaces are generally cylindrical with approximately equal diameters;

(g) said surface first ends are closely spaced from one another;

(h) eccentricity adjusting means associated with each of said surfaces and cooperating with said first and second supporting members to allow rotation of each of said surfaces about an axis thereof and to allow independent eccentric adjustment of said surfaces relative to each other; and (i) eccentricity positioning means cooperating with said eccentricity adjusting means to allow selective positioning of the eccentricity of each surface relative to each other;

(j) whereby the eccentricity of one of said surfaces relative to another is selectively variable whereat said surfaces respectively engage said web.

2. The device according to claim 1 wherein:

(a) said surface first and second ends are articulated relative to one another; and (b) said eccentricity adjusting means further provides for adjustment of the axis of rotation of each of said first and second surfaces to alternatively allow selective adjustment of said surfaces to coaxially align with one another while paralleling the axis of rotation of said shaft, to coaxially align with one another so as to have a common axis non-parallel with the axis of said shaft, or to non-coaxial align with one another and with the axis of said shaft.

3. The device according to claim 2 wherein said eccentric adjusting means comprises:

(a) a first respective bearing unit for each of said first and second supporting members positioned near adjacent inner ends of said first and second supporting members and allowing rotation thereof on said shaft; and (b) second bearing units for each respective first and second supporting member positioned near outer ends of a respective supporting member and allowing rotation of said supporting member about said shaft.

4. The device according to claim 3 wherein:

(a) each of said first bearing units includes an eccentric component which is selectively adjustable to angularly rotate the eccentric component thereof about said shaft.

5. The device according to claim 4 in combination with a continuous web newspaper press.

6. The device according to claim 3 wherein:

(a) each of said second bearing unit eccentric components comprise an eccentric race sleeved on said shaft; and (b) said eccentric positioning means comprises a drive wheel connected to each of said eccentric races to allow selective positioning of said race on about said shaft.

7. The device according to claim 6 wherein:

(a) said eccentricity positioning means further includes a manipulative handle cooperatively connected to said wheel to allow rotation of said race about said shaft.

8. The device according to claim 6 wherein:

(a) said eccentricity positioning means includes a motor cooperatively attached to said drive wheel to selectively position said race about said shaft.

9. The device according to claim 8 wherein:

(a) said eccentricity positioning means further includes an eccentricity sensing device;

(b) a controller unit operably connected to said motor to selectively drive said motor; and wherein (c) said sensing means provides a signal to said controller to allow determination of the relative position of an eccentric bulge associated with a respective surface at the controller such that the controller can be operated to selectively adjust a respective eccentric bulge of a surface.

10. The device according to claim 9 including:

(a) automatic wrinkle sensing means cooperating with said controller to automatically sense longitudinal wrinkles in the web and to automatically signal said controller to adjust the eccentric bulge of one of said surfaces to reduce such wrinkles.

11. In combination:

(a) a continuous web printing press including cylinders of a printing unit, each of said cylinders having an axis of rotation;

(b) a continuous movable paper web reeved through the cylinders of said press and being unwound from a web supply roll having an axis of rotation associated therewith;

(c) an anti-wrinkle device for controlling longitudinal wrinkles in said web as said web passes through said press; said anti-wrinkle device comprising:

(d) a support structure generally fixedly mounted on said press and having a central shaft with an axis associated therewith;

(e) first and second cylindrical surface supporting members mounted to rotate about said shaft;

(f) first and second cylindrical surfaces carried on respective first and second supporting members;

(g) said first and second cylindrical supporting members being aligned such that a first end of each of said first and second cylindrical surfaces is in close proximity to each other;

(h) a first bearing unit associated with each of said cylindrical surface first ends and rotatably mounting a respective supporting member about said shaft;

(i) a second bearing unit associated with each of said surfaces and being located at an opposite end thereof from a respective surface first end; said second bearing units each having an eccentric inner race which is rotatably mounted upon said shaft; each of said bearing races being selectively positionable to produce an eccentric bulge in an outer end of a respective surface such that said surfaces may be alternatively aligned coaxially with one another and coaxially with said shaft, or aligned coaxially with one another but not with said shaft, or not coaxially aligned with one another or with said shaft; and (j) eccentric positioning means cooperating with each of said eccentric races so as to allow selective manipulation of said races to adjust the position of said eccentric bulge; said web engaging said surfaces and said eccentric bulge being adjustable to change the relative tensioning of outer edges of said web relative to each other and to a center of said web.

12. The combination according to claim 11 including:

(a) control means for sensing the eccentric bulge of each of the cylindrical surfaces and including motor means to selectively adjust the eccentric bulge so as to optimally reduce longitudinal wrinkles within said web.

* * * * *